US007117570B1

(12) United States Patent
Borgerding

(10) Patent No.: US 7,117,570 B1
(45) Date of Patent: Oct. 10, 2006

(54) CROSS-SHAPED URN

(76) Inventor: Ted A. Borgerding, 4154 Laura Marie Dr., Waynesville, OH (US) 45068

( * ) Notice: Subject to any disclaimer, the term of this patent is extended or adjusted under 35 U.S.C. 154(b) by 0 days.

(21) Appl. No.: 10/907,572

(22) Filed: Apr. 6, 2005

(51) Int. Cl.
*A61G 17/00* (2006.01)

(52) U.S. Cl. ..... 27/1; 40/124.5

(58) Field of Classification Search ..... 27/1; D99/5, 23; 40/124.5, 722; 206/19; 362/121
See application file for complete search history.

(56) References Cited

U.S. PATENT DOCUMENTS

| | | | | | |
|---|---|---|---|---|---|
| 1,391,945 | A | * | 9/1921 | Flagge | 362/121 |
| 1,649,086 | A | * | 11/1927 | Spillane | 206/19 |
| 1,909,249 | A | * | 5/1933 | Blanchard | 206/19 |
| 2,076,701 | A | * | 4/1937 | Buck | 206/19 |
| 2,325,883 | A | * | 8/1943 | Schleif | 362/121 |
| 2,748,994 | A | * | 6/1956 | Scharenbroich | 222/448 |
| 4,199,848 | A | | 4/1980 | Kohnert | |
| D268,623 | S | | 4/1983 | Dercks et al. | |
| D272,577 | S | | 2/1984 | Dercks et al. | |
| 4,648,162 | A | | 3/1987 | Daino | |
| 5,625,933 | A | | 5/1997 | Neuberger et al. | |
| 5,704,103 | A | | 1/1998 | Crowley et al. | |
| 5,875,528 | A | | 3/1999 | Parker | |
| 5,896,632 | A | | 4/1999 | Sturino | |
| D445,557 | S | * | 7/2001 | Chang | D99/5 |
| 6,295,705 | B1 | * | 10/2001 | Gersten | 27/1 |
| 6,526,636 | B1 | * | 3/2003 | Bernhardt | 27/1 |
| 6,662,416 | B1 | * | 12/2003 | Huggins | 27/1 |
| 6,735,831 | B1 | * | 5/2004 | Greiwe et al. | 27/1 |
| D492,079 | S | | 6/2004 | Feltman | |
| 2003/0115728 | A1 | * | 6/2003 | Robert | 27/1 |
| 2004/0031434 | A1 | * | 2/2004 | VandenBiesen et al. | 117/1 |

* cited by examiner

*Primary Examiner*—William L. Miller
(74) *Attorney, Agent, or Firm*—R. William Graham

(57) ABSTRACT

A cross shaped container includes a cross shaped member having four arms which are communicably connected at a central portion, wherein the arms are generally hollow and each arm has a cap for sealing a terminal end thereof. A pedestal base supportively connects to one of the arms in a manner to support the cross shaped member in an upright manner.

4 Claims, 5 Drawing Sheets

CROSS-SHAPED URN

FIELD OF THE INVENTION

This invention generally relates to a cross shaped container and more particularly to a novel cross-shaped burial urn for retaining the cremated remains of a deceased person.

BACKGROUND OF THE INVENTION

As an alternative to expensive casket burial, cremation is used today for a deceased person. Cremation enables less land use wherein cremated remains can be easily stored within a container in a home or church and can be easily transferred between locations.

Prior art discloses numerous burial urns. For example, burial urns have been produced in the form of books, boxes, pyramids, figure heads, and rocks. Prior urns have been made of various materials, such as wood, metal and in some cases include a see through glass portion. The prior art urns disclose an engraved plate indicating the name, date of birth, and date of death of the deceased and/or a frame containing a photograph or a written memorial to the person.

While these prior designs have met with some success, there remains a need for a more aesthetically pleasing urn or container which can be relatively easily manufactured.

SUMMARY OF THE INVENTION

Accordingly it is an object of the present invention to provide a storage container which can be used in remembrance of a person.

It is another object to provide a cross-shaped urn that is aesthetically pleasing.

It is another object to provide a cross-shaped container that is aesthetically pleasing.

Another object is to provide a cross-shaped burial urn having means for displaying an engraved plate indicating the name, date of birth, and date of death of the deceased and/or a frame containing a photograph or a written memorial to the person.

Yet another object of the present invention is to provide a translucent urn constructed in the shape of a cross that can be mounted in a base.

Accordingly, the present invention is directed to a storage container which can preferably be used for storing the cremated remains of a deceased person. The container shown is constructed in the shape of a cross, which can be molded or otherwise constructed from a translucent plastic material. The cross shaped container has four arms which are generally hollow with means to seal a terminal end of each arm. A pedestal base is provided which supportively connects to one of the arms. Means for displaying a memorial of the deceased person such as a photograph and written life history of the person is connected to one side of the cross, preferably a central portion of the cross. The display means is of a small enough size to permit viewing at least a portion each arm.

The storage container can be used to retain the cremated remains or optionally some other material, such as sand, in remembrance of the person. The terminal ends of the arms can optionally be permanently sealed with an adhesive or the like after the material is poured into the container. It is understood that three of the arms are preferably sealed first prior to filling the container.

The arms are shown in a tubular form, which can be cylindrical, for example. Other shapes are contemplated by the invention.

The display means can be a frame which is connected, preferably adjacent an intersection of the arms. The frame includes a transparent cover plate which is fitted into the frame for protecting the memorial which plate is retained in a mounting groove on the frame by a back-up plate attached to the frame. A space between the back-up plate and transparent cover contains the memorial and other documents.

Other objects, advantages, and capabilities of the present invention will become more apparent as the description proceeds taken in conjunction with the accompanying drawing.

DESCRIPTION OF THE PREFERRED EMBODIMENT

Figure 1:
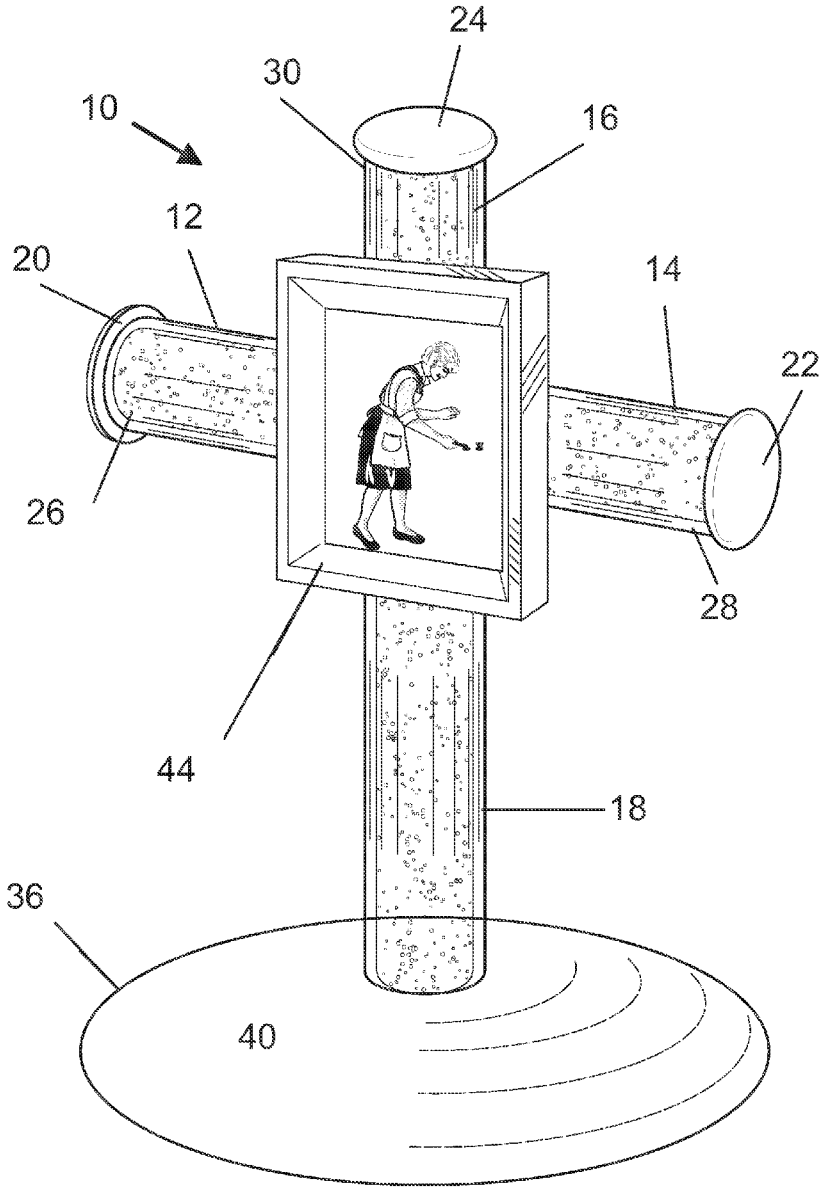
FIG. 1 is a front perspective view of the present invention.
Figure 2:
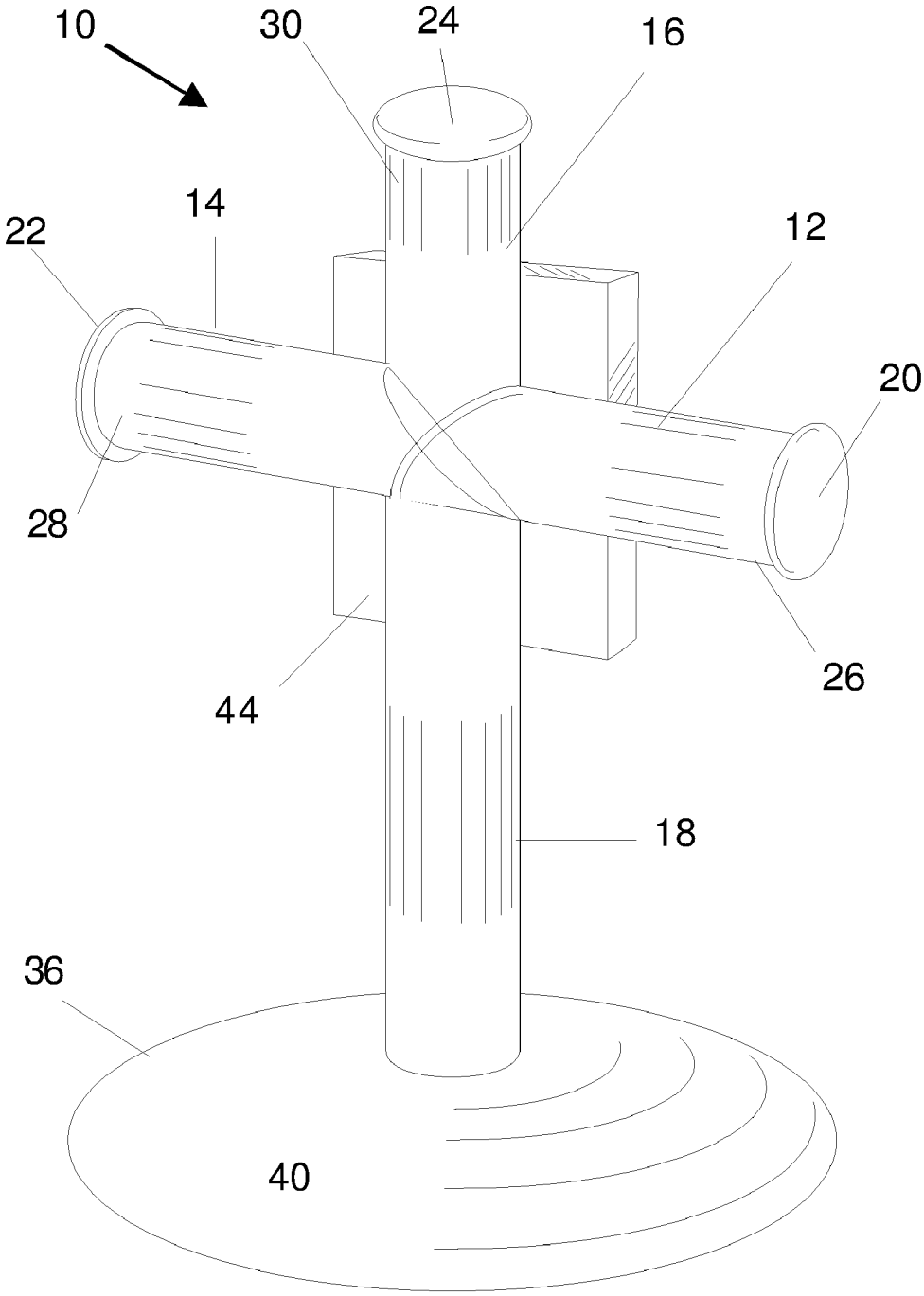
FIG. 2 is a back perspective view of the present invention.
Figure 3:
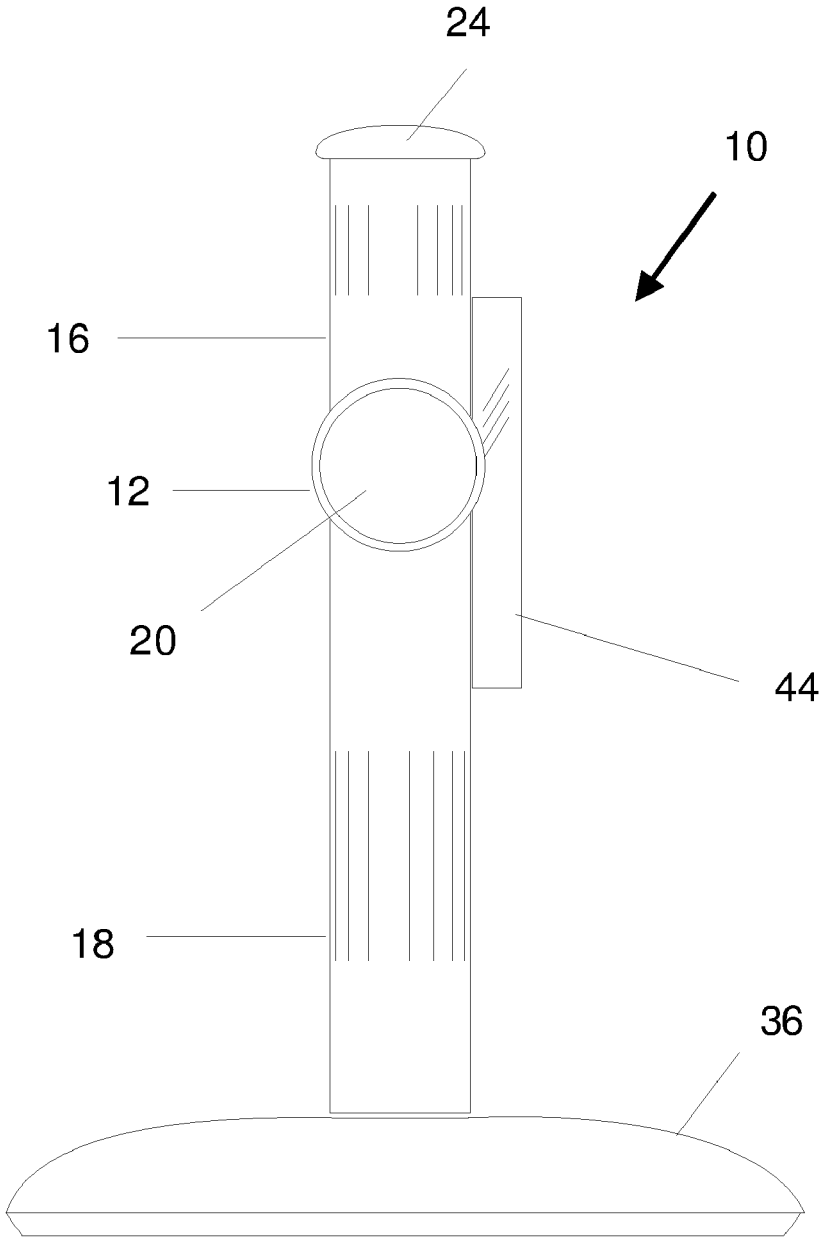
FIG. 3 is a side view taken from the left FIG. 1.
Figure 4:
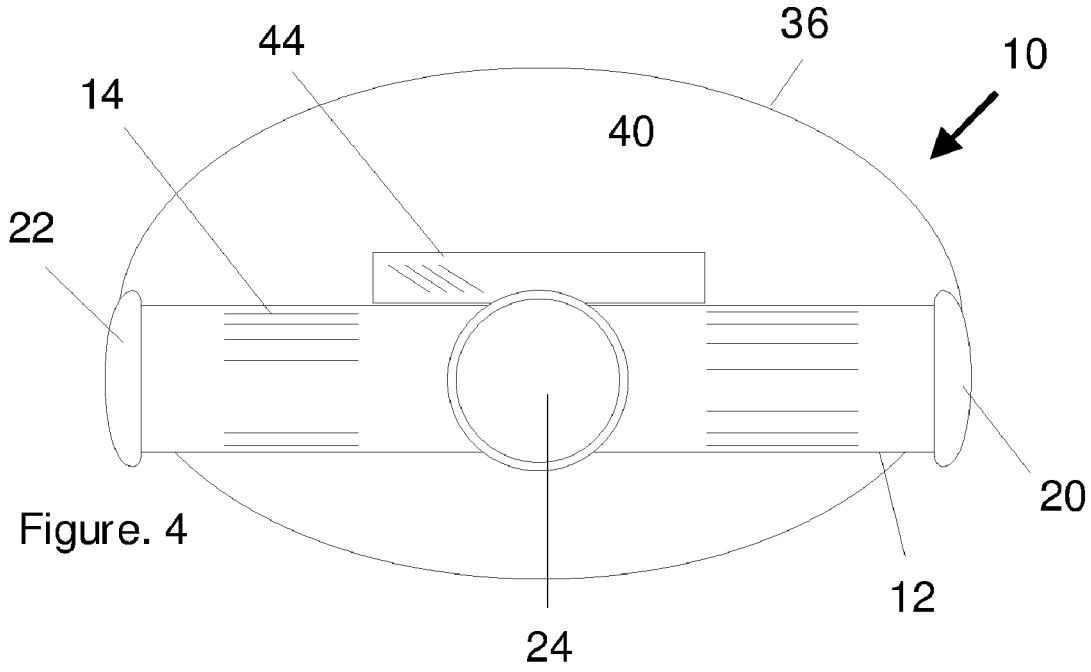
FIG. 4 is a top view of the present invention.
Figure 5:
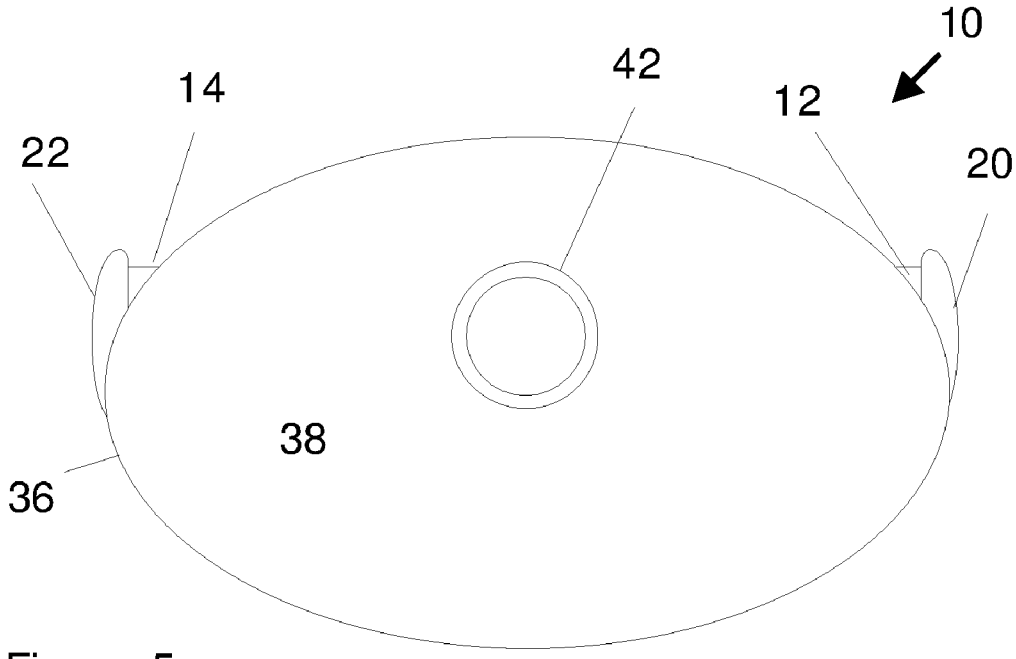
FIG. 5 is a bottom view of the present invention.
Figure 6:
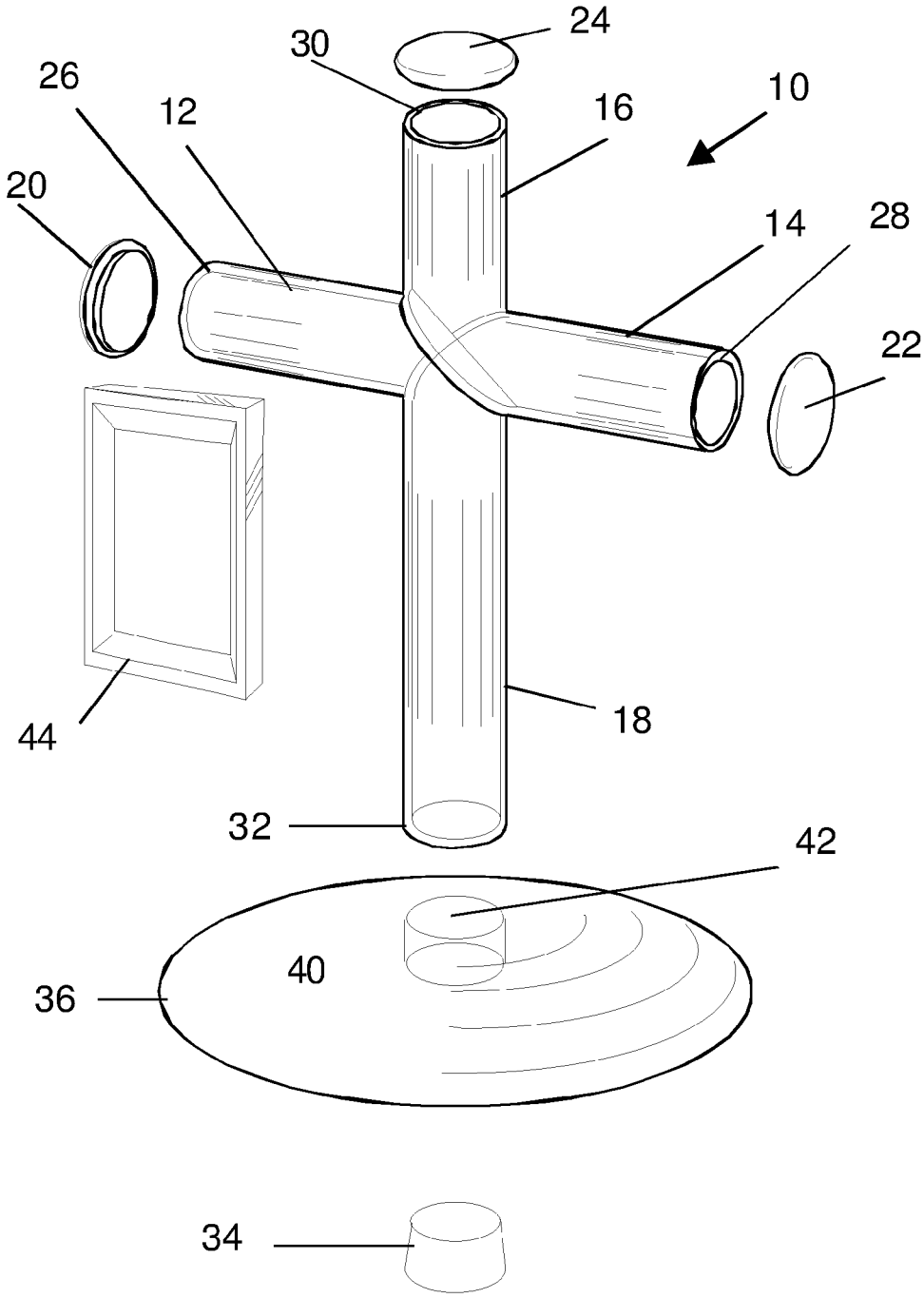
FIG. 6 is an exploded view showing parts of an embodiment of the present invention.

Referring now to the drawings, the container of the present invention is generally designated as 10 is shown assembled in FIGS. 1–5 and unassembled in FIG. 6. The container 10 can preferably be used for storing the cremated remains of a deceased person. The container 10 shown is constructed in the shape of a cross, which can be molded or otherwise assembled from a translucent plastic material. The cross shaped container 10 has four arms 12, 14, 16 and 18, wherein arms which are generally hollow. There are provided a plurality of decorative and aesthetically pleasing caps 20, 22 and 24 to seal a respective terminal end 26, 28 and 30 of each arm 12, 14 and 16. For example, the caps 22, 22 and 24 can be of a silver or gold colored material. The caps 20, 22 and 24 each include a neck which is configured to friction fit within the respective terminal end 26, 28 and 30. A terminal end 32 of arm 18 is provided with a cap or plug 34, which need not be decorative as this will remain unseen.

A pedestal base 36 is provided having a generally flat bottom surface 38 and an upper surface 40. An arm receiving surface 42 is formed in the base 36 which supportively receives end 32 of arm 18. The base 36 can be made of a suitable aesthetic material, such as stone, ceramic, metal.

Means 44 for displaying a memorial of the deceased person such as a photograph and written life history of the person is connected to one side of the cross, preferably a central portion of the cross. The display means 44 can preferably be small enough size to permit viewing at least a portion each arm 12, 14, 16 and 18.

The container 10 can be used to retain the cremated remains or optionally some other material, such as sand, in remembrance of the person. The terminal ends 26, 28, 30 and 32 of the respective arms 12, 14, 16 and 18 can optionally be permanently sealed with an adhesive or the like after the material is poured into the container 10. Here, the exemplary embodiment shows that three of the arms 12, 14 and 16 are preferably sealed first prior to filling the container 10 through the arm 18.

The arms 12, 14, 16 and 18 are shown in a tubular form, which can be cylindrical, for example. Other shapes are contemplated by the invention. The arms 12, 14, 16 and 18 are preferably of a transparent material such as plastic, glass or other synthetic material.

The display means 44 can be frame which is connected, preferably adjacent an intersection of the arms 12, 14, 16 and 18. The frame includes a transparent cover plate which is fitted into the frame for protecting the memorial which plate is retained in a mounting groove on the frame by a back-up plate attached to the frame. A space between the back-up plate and transparent cover contains the memorial and other documents. The frame can preferably include a matching colored material to caps 22, 22 and 24, such as silver or gold, for example.

Although the present invention has been described with a certain degree of particularity, it is understood that the present disclosure has been made by way of example and that changes in details of structure may be made without departing from the spirit thereof.

What is claimed is:

1. A cross shaped urn, comprising:

a cross shaped member having four arms which are communicably connected at a central portion of said cross shaped member, wherein said arms are generally hollow and translucent and each said arm having means for sealing a terminal end of each said arm;

a displaying means connected to said central portion of said cross shaped member for displaying an article therein;

a pedestal base supportively connecting to one of said arms in a manner to support said cross shaped member in an upright manner; and human remains sealably contained within said arms in a manner to permit visual inspection thereof.

2. The cross shaped urn of claim 1, wherein said sealing means includes a decorative end cap for at least one of said arms.

3. The cross shaped urn of claim 1, wherein said displaying means includes a photograph of a deceased person.

4. The cross shaped urn of claim 1 wherein said displaying means is of a small enough size to permit unobstructed viewing of at least a portion of each said arm.

* * * * *